US008166851B2

(12) United States Patent
Pchola et al.

(10) Patent No.: US 8,166,851 B2
(45) Date of Patent: May 1, 2012

(54) COMBINATION DRIVING TOOL FOR PHILLIPS AND ROBERTSON FASTENERS

(75) Inventors: Edward Pchola, Chicago, IL (US); Kenneth C. Osberg, Lake in the Hills, IL (US); Hagen Walter Dost, Chicago, IL (US); Wade Nachtigall, Chicago, IL (US); Jonathan Markwald, Elmhurst, IL (US)

(73) Assignee: Robert Bosch GmbH, Stuttgart (DE)

( * ) Notice: Subject to any disclaimer, the term of this patent is extended or adjusted under 35 U.S.C. 154(b) by 313 days.

(21) Appl. No.: 12/475,933

(22) Filed: Jun. 1, 2009

(65) Prior Publication Data

US 2010/0037737 A1 Feb. 18, 2010

Related U.S. Application Data

(60) Provisional application No. 61/089,337, filed on Aug. 15, 2008.

(51) Int. Cl.
*B25B 23/00* (2006.01)

(52) U.S. Cl. ..... 81/460

(58) Field of Classification Search ..... 81/460, 81/461, 436

See application file for complete search history.

(56) References Cited

U.S. PATENT DOCUMENTS

| | | | | |
|---|---|---|---|---|
| 2,046,343 | A | 7/1936 | Phillips | |
| 2,046,837 | A | 7/1936 | Phillips | |
| 2,046,838 | A | 7/1936 | Phillips | |
| 2,046,840 | A | 7/1936 | Phillips | |
| 2,116,775 | A | 5/1938 | Blackburn | |
| 2,182,568 | A | 12/1939 | Olson | |
| 2,366,682 | A * | 1/1945 | West et al. | 81/460 |
| 3,396,765 | A | 8/1968 | Ridenour | |
| 4,089,357 | A * | 5/1978 | Gill | 81/460 |
| 4,488,462 | A | 12/1984 | Wall | |
| 5,020,954 | A | 6/1991 | Dreger | |
| 5,358,368 | A | 10/1994 | Conlan et al. | |
| 6,164,171 | A * | 12/2000 | Kaneko et al. | 81/460 |
| 6,289,775 | B1 | 9/2001 | Wei | |
| 6,352,011 | B1 | 3/2002 | Fruhm | |
| 6,584,876 | B2 * | 7/2003 | Totsu | 81/460 |
| 6,843,729 | B2 | 1/2005 | Hughes | |
| 6,852,037 | B2 | 2/2005 | Hughes | |
| 6,890,139 | B2 | 5/2005 | Hughes | |
| 7,225,710 | B2 | 6/2007 | Pacheco, Jr. | |

FOREIGN PATENT DOCUMENTS

| | | |
|---|---|---|
| WO | WO 2004/065802 | 8/2004 |
| WO | WO 2006/130490 | 12/2006 |

* cited by examiner

*Primary Examiner* — Debra S Meislin
(74) *Attorney, Agent, or Firm* — Greer, Burns & Crain, Ltd.

(57) ABSTRACT

Embodiments of a driving tool are disclosed that comprise a shank portion, and a working portion, wherein the working portion is configured to drive either a Phillips head fastener or a Robertson® head fastener.

19 Claims, 5 Drawing Sheets

COMBINATION DRIVING TOOL FOR PHILLIPS AND ROBERTSON FASTENERS

BACKGROUND OF THE INVENTION

The present invention generally relates to drivers for driving threaded fasteners having various head configurations.

It is well known that there are many different threaded fasteners and screws that have different types of recesses or outer surface configurations that can be driven by drivers that can vary from driver bits that are held in sockets of pneumatic or electric motor driven tools or merely have the handle for a user to manually rotate the fastener to tighten or loosen the same.

Aside from the conventional single slotted screws, the most popular configuration for screws is the Phillips head screws as well as the Robertson® screws. The recess of the Phillips head is the well known cross slotted configuration which is defined by ISO standard 8764-2004(E), and is shown in the inspection gauge of FIG. 3 thereof, which is specifically incorporated by reference herein. The Phillips head recess does not experience the easy disengagement of the screwdriver as compared to a single slotted head because the bit is captured on all sides within the recess. The Robertson® recess is defined in the Draft revision ASME B13.6.3 2002 standard for type III pan head machine screws, and also specifically incorporated by reference herein. The Robertson® configuration square recess also captures the driver on all sides.

Drivers have been designed and commercialized which are capable of driving more than one configuration of a threaded fastener, such as a slotted head and a Phillips head. Such combination drivers can be convenient for a user if the combination can effectively engage more than one type of head configuration, because a single driver rather than multiple ones can be used.

A combination driver that is effective to drive both Phillips head screws and Robertson® screws would be highly desirable and is not known to be commercially available.

SUMMARY OF THE INVENTION

Embodiments of a driving tool are disclosed that comprise a shank portion, and a working portion, wherein the working portion is configured to drive either a Phillips head fastener or a Robertson® head fastener.

DETAILED DESCRIPTION

Figure 1:
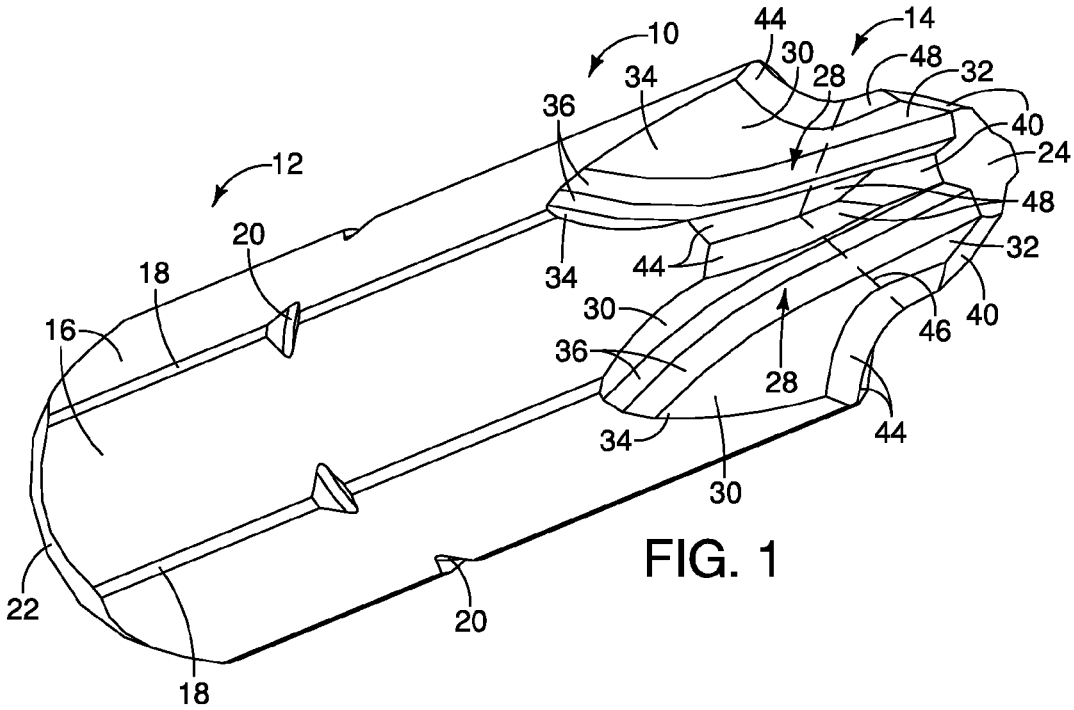
FIG. 1 is a perspective view of a preferred embodiment of a combination bit that is capable of driving both Phillips head and Robertson® head screws and fasteners.

Two embodiments of the present invention are shown in the drawings, both of which are directed to a combination bit that is capable of driving threaded fasteners and screws that have a Phillips head portion or a Robertson® head portion. The drawings all show a combination bit that has a hexagonal shank which is configured to be held in a socket of some type of tool which may be a manual screwdriver with a screwdriver handle, or it may fit in a socket that is a part of a pneumatic driven wrench or an electrically driven tool or other type of tool. It should be understood that while a manual handle is not shown in the drawings, the shank of the bits that are illustrated could be a long shaft attached to a handle with a working portion or tip that is configured to drive the Phillips head or Robertson® head screws or other fasteners.

Turning now to the drawings, and particularly FIG. 1, the combination bit is indicated generally at 10 and includes a shank portion, indicated generally at 12 and a working portion or tip indicated generally at 14. While the shank portion 12 may have any one of many different configurations, including a cylindrical shape, it is preferred that it have a hexagonal cross section with six flat faces 16 with adjacent faces having a narrow flat portion 18 at the intersection thereof. It is also preferred that the flat portions have notches 20 for interfacing with a quick connect adaptor which secures the bit in a socket tool. The outer circumference 22 of the free end of the shank portion 12 is chamfered to facilitate easy insertion of the bit into a suitable socket. While other configurations for the shank portion 12 can be used, the illustrated shank is preferably a standard insert bit shank per DIN 3126 form C6.3.

Figure 2:
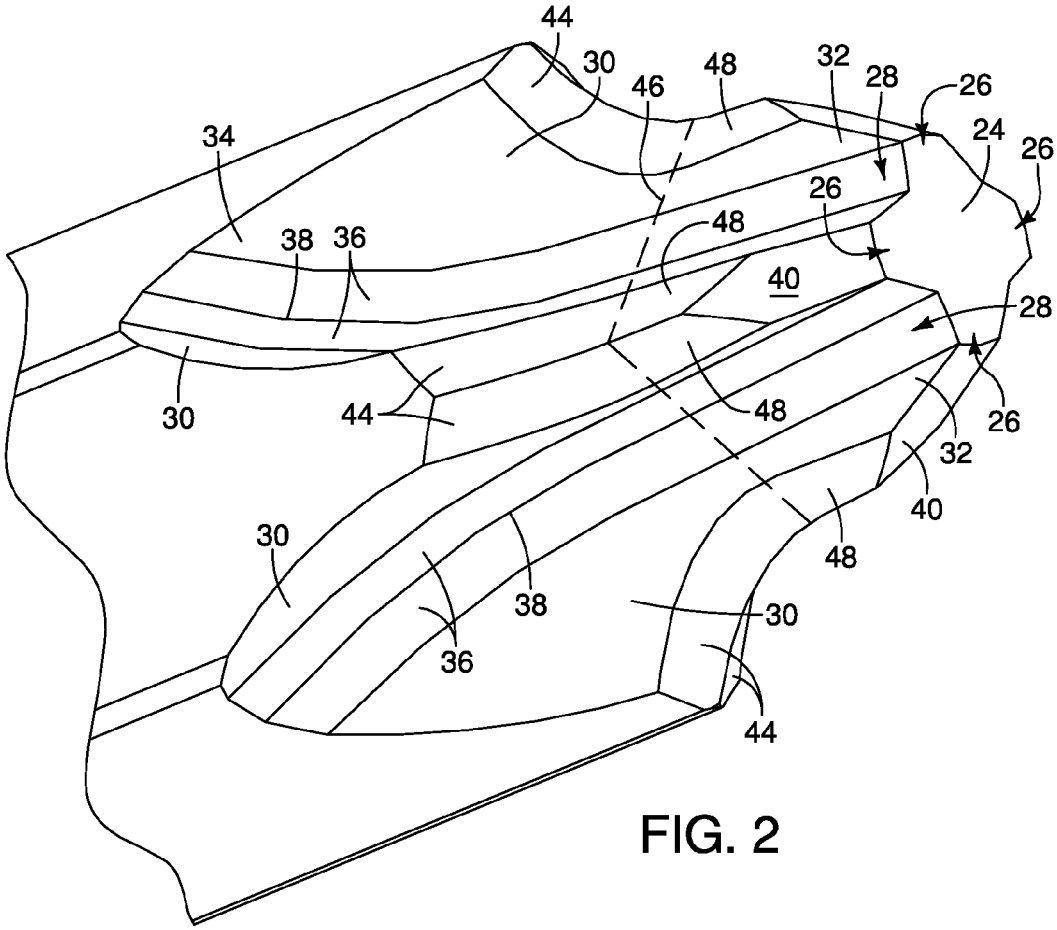
FIG. 2 is an enlargement of a tip or working portion of the combination bit shown in FIG. 1.
Figure 3:
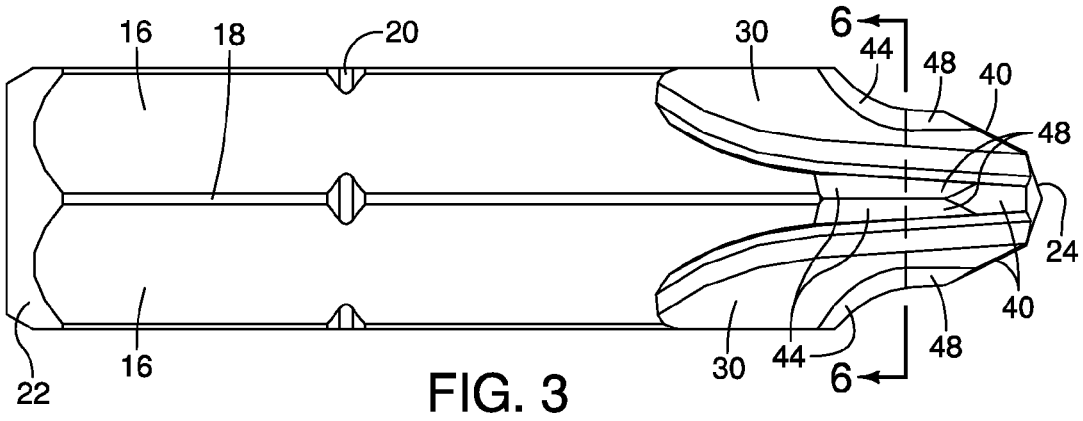
FIG. 3 is a plan view of the combination bit shown in FIG. 1.
Figure 4:
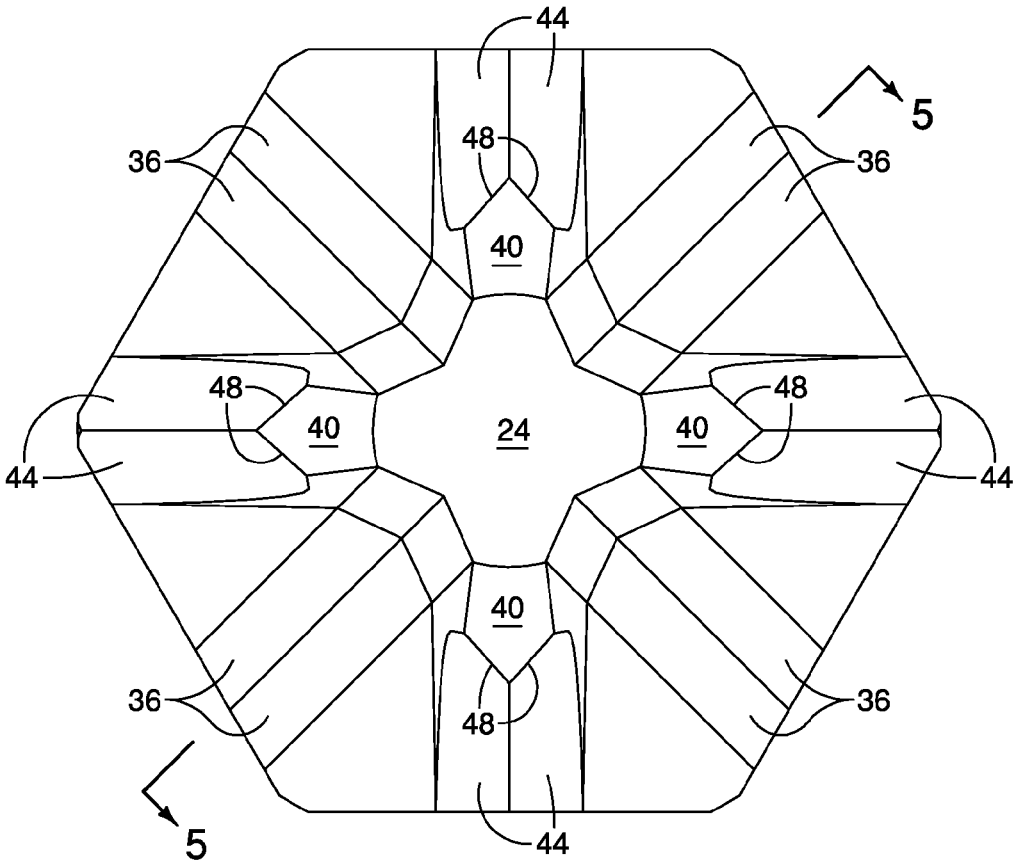
FIG. 4 is an end view of the tip portion of the combination bit shown in FIG. 1.
Figure 5:
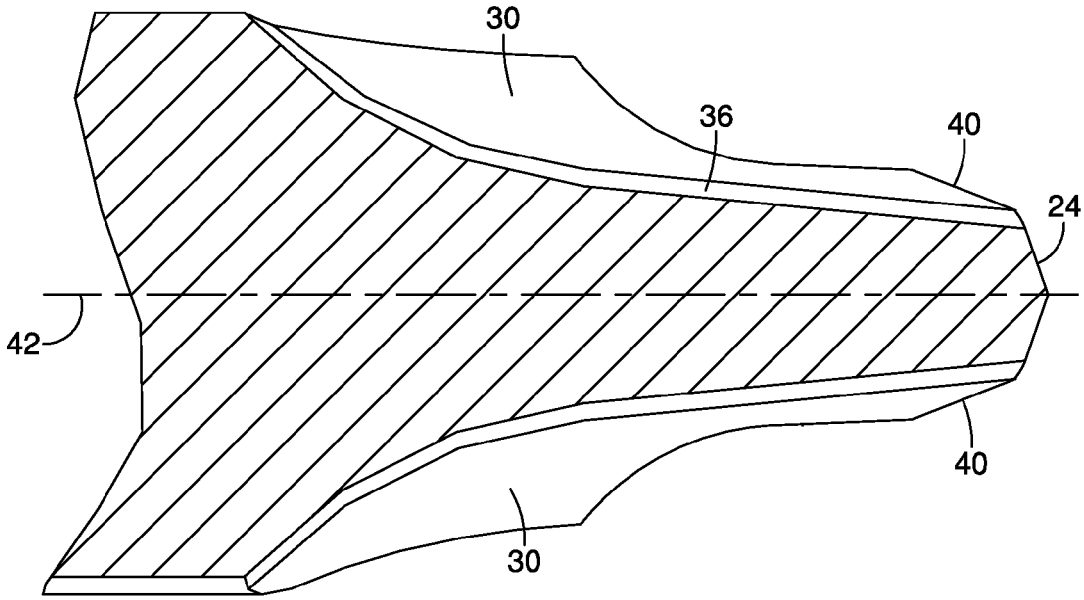
FIG. 5 is a cross section taken generally along the line 5-5 of FIG. 4.

Turning now to the working portion 14, it has a slightly conical end surface 24 with a generally cross shape, with rib portions, indicated generally at 26, each of which is oriented in a substantially 90° relative to adjacent ribs, with each of the ribs 26 being separated by elongated major flutes, indicated generally at 28, which extend from the end surface 24 toward the shank portion 12 and gently curve outwardly to the surface. As is best shown in FIG. 2, each of the ribs has side walls 30 on opposite side portions that extend from a front location 32 where it terminates at the end surface 24 to the other end where it terminates near the outer surface of the shank portion 12 as identified at 34. The side walls 30 are generally planar with the distance between the walls being generally slightly smaller than the width of the slots in a Phillips head configuration recess.

The flutes 28 also have a bottom trough section that is generally shown to have trough side portions 36 as well as a center bottom line 38. It should be understood that the drawings are line drawings are slightly exaggerated for the sake of clarity. In this regard it should be understood that the two trough side portions 36 as well as the center bottom line 38 may be curved relative to one another and the interface between the side walls 30 and the trough side portions 36 may also be gently curved, which smoothing is consistent with the actual shape of many Phillips head screwdriver tips.

With regard to the ribs 26, they extend from the end surface 24 to the shank portion 12 and have an angled flat face 40 that is approximately at an angle of 26° relative to a longitudinal center axis 42 of the bit. The flat face 40 extends to a pair of side panels 44 which gently curve to terminate at an approximately 26° angle relative to the face 16 of the shank portion.

Figure 6:
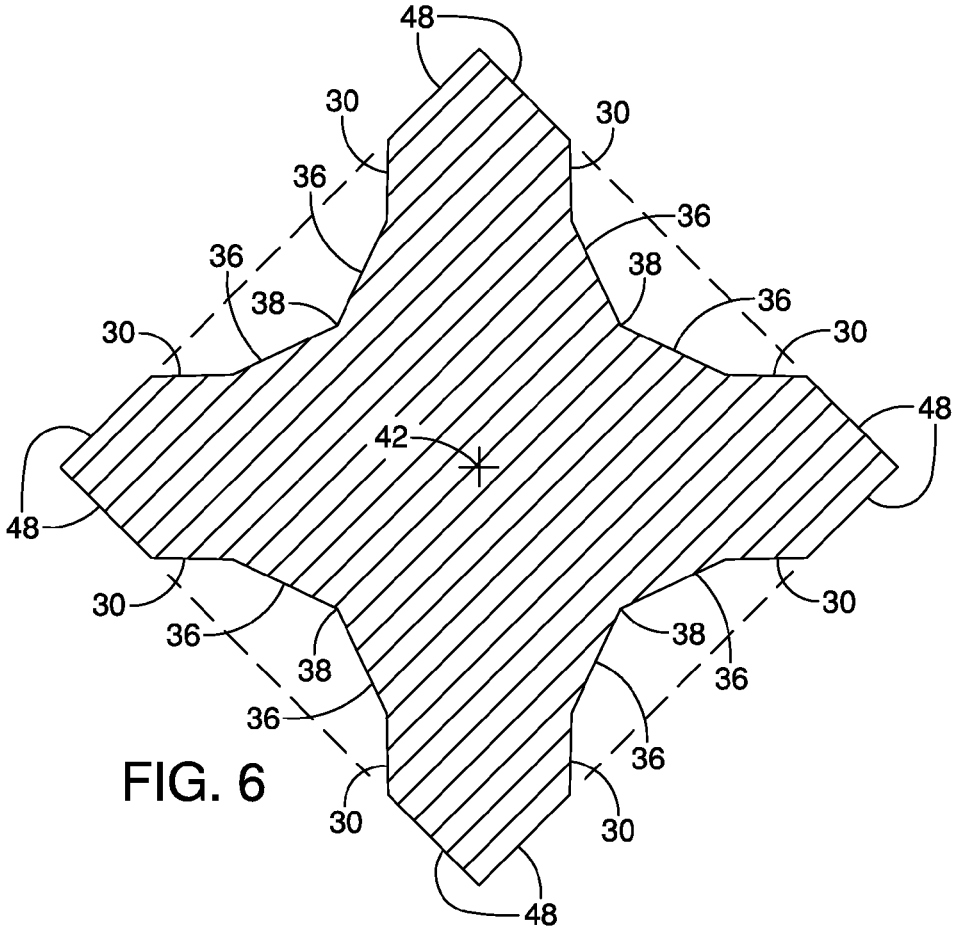
FIG. 6 is a cross section taken generally along the line 6-6 of FIG. 3.
Figure 7:
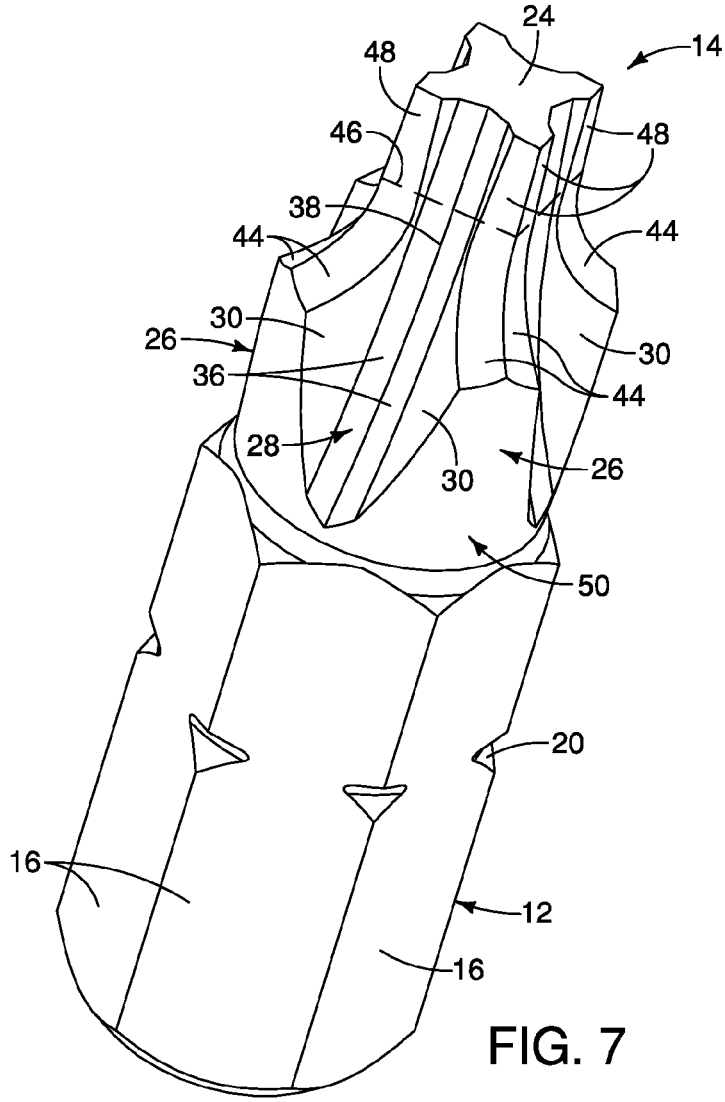
FIG. 7 is a perspective view of an alternative embodiment of a combination bit that is capable of driving both Phillips head and Robertson® head screws and fasteners.
Figure 8:
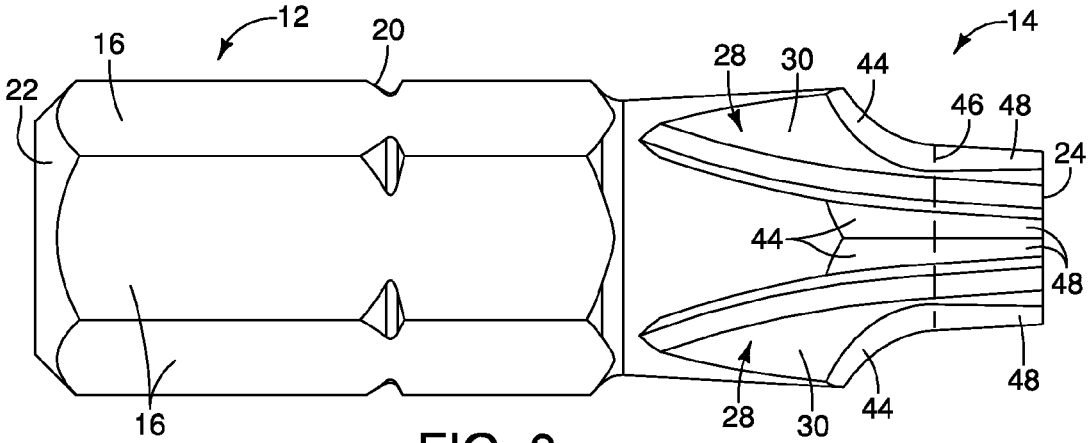
FIG. 8 is a side plan view of the alternative combination bit shown in FIG. 7.
Figure 9:
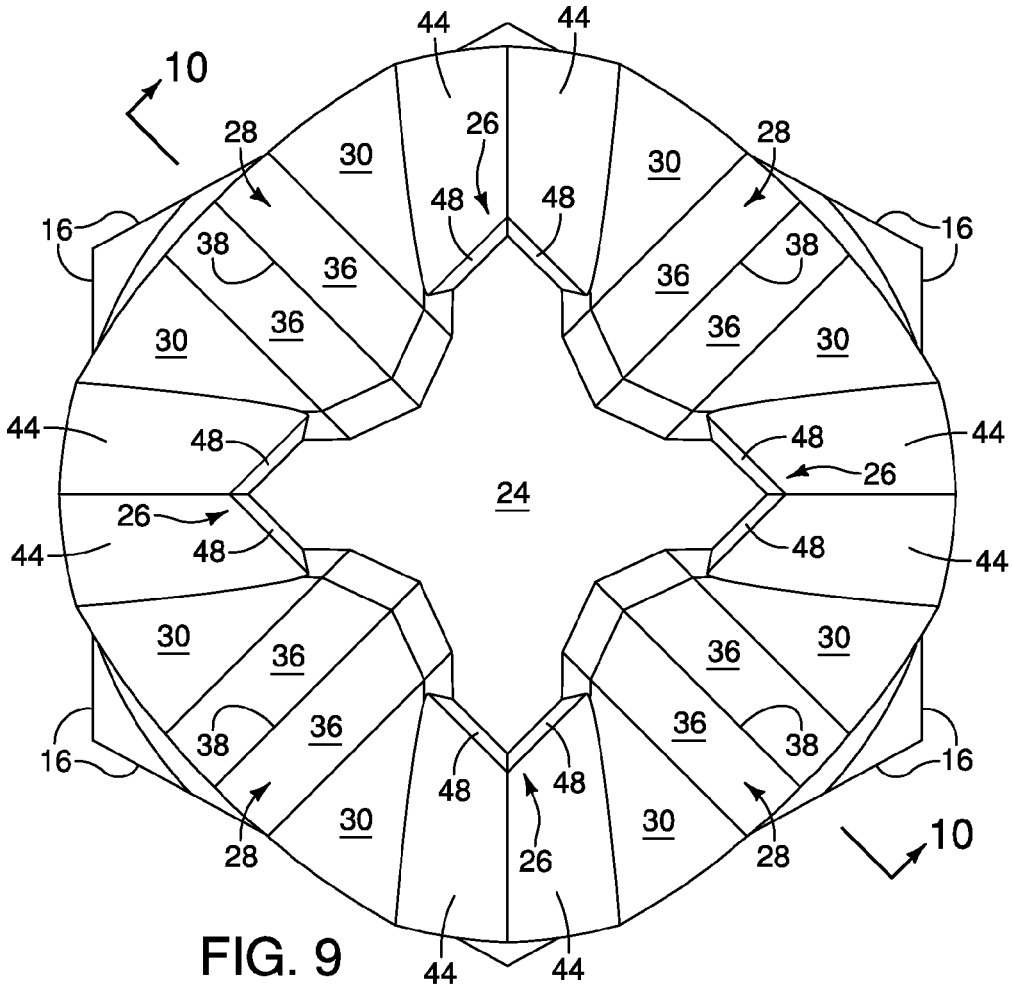
FIG. 9 is a end view of the tip portion of the combination bit shown in FIG. 7.
Figure 10:
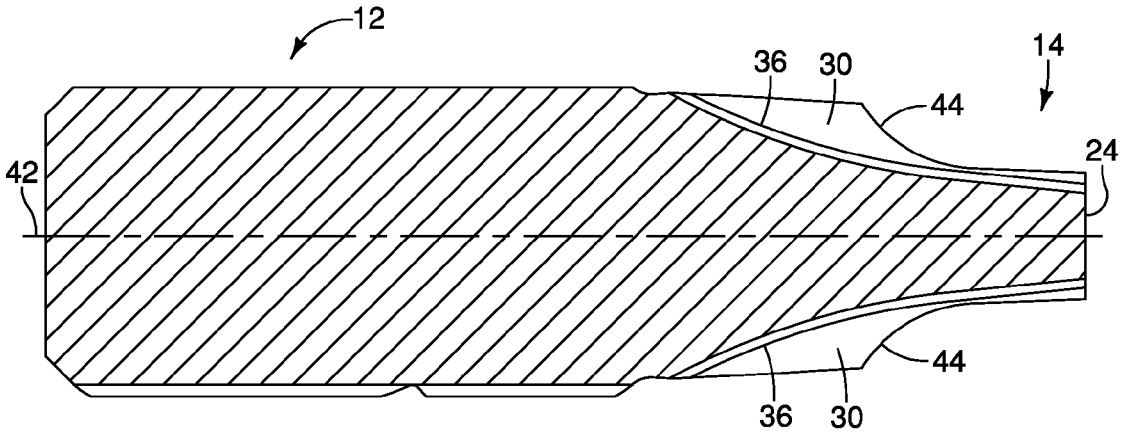
FIG. 10 is a cross section taken generally along the line 10-10 of FIG. 9.

Importantly, a dotted line 46 identifies a transition portion where the side panels 44 on the ribs 26 extending toward the tip end surface 24 are essentially planar and tapered inward toward the center axis 42 of the bit 10 at an approximate angle of 2.5 degrees. The side panels 44 then curve outwardly as shown in FIGS. 1 and 2 as they extend to the shank portion flat faces 16. Thus, the segments between the line 46 and the angled flat surface 40, identified at 48, present planar segments that are parallel to the center axis 42 and substantially perpendicular to one another in the axial direction, as can be seen in the cross section shown in FIG. 6. These panel segments 48 of each of the four ribs 26 form a square as shown in FIG. 6 which is slightly smaller than the recess of a Robertson® head fastener. Thus, the geometry is such that the panel segments 48 are oriented to contact the inside surfaces of the recess for driving a Robertson® screw or fastener.

Turning now to an alternative embodiment of the present invention and referring to FIGS. 7-10, another combination bit is shown which is also configured to drive a Phillips head fastener as well as a Robertson® fastener. It should be understood that the reference numbers that have been applied to the first preferred embodiment are repeated for corresponding surfaces and shapes in the alternative embodiment, but slight differences in the configuration will be apparent. The major differences are that the working portion 14 has a base portion, indicated generally at 50, which is cylindrical in shape so that there is a transition from the circular base portion 50 to the hexagonal shank portion 12 that is not present in the embodiment shown in FIGS. 1-6. Therefore, the flutes 28 terminate in the cylindrical base portion 50 rather than in the sides faces 16 of the hexagonal shank portion. The tip or working portion 14 as shown in FIGS. 7-10 is also more severely truncated in that the end surface 24 has a larger surface area and in fact approximates the size of the transition portion 46 to present a greater surface area for the panel segments 48 that engage the interior walls of the Robertson® cubic recess.

By truncating the outer tip so that the end surface is larger than that shown in FIGS. 1-6, the angled faces 40 are eliminated. However, the depth represented by the distance between the end surface 24 and the transition line 46 can still be inserted into the corresponding Phillips head fastener recess so that greater purchase can be obtained to drive the Phillips head fastener. Because of the greater surface area of the contact surfaces represented by the panel segments 48, the alternative embodiment tends to favor driving the Robertson® head fastener whereas the embodiment shown in FIGS. 1-6 tends to favor the driving of a Phillips head fastener. It should be understood that a balance between the effectiveness of driving each type of fastener can be varied by the degree to which the tip is varied as demonstrated by the two alternatives shown in the drawings of the present application.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A driving tool for driving either a square-recessed head fastener or a Phillips head fastener, comprising:

a shank portion;

a bit portion, the outer end surface of which defines a symmetrical cross head configuration for insertion into a Phillips head fastener;

said bit portion having four ribs and four flutes that alternate with one another and extend from said outer end surface longitudinally toward said shank portion, said flutes curving generally outwardly away from a center longitudinal axis to a first outer surface longitudinal position on said bit portion where they terminate;

said ribs being defined by said adjacent flutes, each rib having a predetermined width and a transition portion extending from at least near said outer end surface to at least a first predetermined distance, said transition portion having two symmetrical side panels that interface one another at a generally 90 degree angle, so that said side panels of all four ribs define a square configuration that can drive a square-recessed head fastener when said bit is inserted into the same.

2. A driving tool as defined in claim 1 wherein said shank portion has a hexagonal cross-section.

3. A driving tool as defined in claim 1 wherein said tool is a bit configured to be installed in a driving mechanism.

4. A driving tool as defined in claim 1 wherein said shank portion is a configured to be attached to a handle.

5. A driving tool as defined in claim 1 wherein said predetermined width is slightly smaller than the width of recesses that define the cross slots of the Phillips head fastener.

6. A driving tool as defined in claim 1 wherein said first predetermined distance generally corresponds to the depth of a recess of the square-recessed head fastener.

7. A driving tool as defined in claim 1 wherein said side panels are substantially parallel to said center longitudinal axis.

8. A driving tool as defined in claim 1 wherein said first position is on said shank portion of said bit.

9. A driving tool as defined in claim 1 wherein said bit portion has a generally cylindrical base portion merging with said shank portion.

10. A driving tool as defined in claim 9 wherein said ribs curve outwardly from said center longitudinal axis beyond said first predetermined distance from said outer end surface.

11. A driving tool as defined in claim 1 wherein said ribs curve outwardly from said center longitudinal axis beyond said first distance from said outer end surface.

12. A driving tool as defined in claim 1 wherein each rib has a flat portion extending from said outer end surface outwardly at a predetermined angle and extends to a second outer surface longitudinal position.

13. A driving tool as defined in claim 12 wherein said predetermined angle is approximately 26 degrees relative to said center longitudinal axis.

14. A driving tool as defined in claim 12 wherein said second position is a second distance that is less than said first predetermined distance.

15. A driving tool as defined in claim 14 wherein said second position is on said shank portion.

16. A driving bit for driving either a square-recessed head fastener or a Phillips head fastener, comprising:

a shank portion;

a bit portion having a Phillips head fastener driver configuration with a truncated tip for insertion into a recess that define the cross slots of a Phillips head;

said bit portion having four ribs in which adjacent ribs are oriented substantially 90 degrees relative to one another, with adjacent ribs being separated by a curved flute that extend from said truncated tip of said shank portion, said ribs being defined by said adjacent flutes, each rib having a predetermined width at said truncated tip generally corresponding to the width of said cross slots and a transition portion extending from said truncated tip to at least a first predetermined distance, at least a segment of said transition portion having two symmetrical flat side panels that interface one another at a generally 90 degree angle, so that said flat side panels of all four ribs define a square configuration that can drive a square-recessed head fastener when said bit is inserted into the same.

17. A driving bit as defined in claim 16 wherein said first predetermined distance enables said bit to be inserted into the square-recessed head fastener so that said flat side panels have substantial contact with the cubic recess of the square-recessed head fastener to drive the same.

18. A driving bit as defined in claim 16 wherein said flutes curve generally outwardly away from a center longitudinal axis to a first outer surface longitudinal position on said bit portion where they terminate.

19. A driving bit as defined in claim 16 wherein the width of said ribs increases beyond said first predetermined distance in a direction toward said shank portion.

* * * * *